US008079825B2

(12) United States Patent
Bocchiola

(10) Patent No.: US 8,079,825 B2
(45) Date of Patent: Dec. 20, 2011

(54) SENSOR-LESS CONTROL METHOD FOR LINEAR COMPRESSORS

(75) Inventor: Cesare Bocchiola, Milanese (IT)

(73) Assignee: International Rectifier Corporation, El Segundo, CA (US)

( * ) Notice: Subject to any disclaimer, the term of this patent is extended or adjusted under 35 U.S.C. 154(b) by 1339 days.

(21) Appl. No.: 11/676,713

(22) Filed: Feb. 20, 2007

(65) Prior Publication Data

US 2007/0196214 A1 Aug. 23, 2007

Related U.S. Application Data

(60) Provisional application No. 60/775,283, filed on Feb. 21, 2006.

(51) Int. Cl.
*F04B 49/06* (2006.01)

(52) U.S. Cl. ..... 417/44.1; 700/282; 62/6; 318/132; 318/135; 310/12.04

(58) Field of Classification Search ..... 700/282; 417/44.1; 62/6; 318/132, 135; 310/12.04
See application file for complete search history.

(56) References Cited

U.S. PATENT DOCUMENTS

| | | | | |
|---|---|---|---|---|
| 3,886,419 | A * | 5/1975 | Omura et al. | 318/132 |
| 5,342,576 | A | 8/1994 | Whitehead | |
| 5,496,153 | A | 3/1996 | Redlich | |
| 5,809,792 | A | 9/1998 | Song | |
| 5,947,693 | A | 9/1999 | Yang | |
| 5,980,211 | A | 11/1999 | Tojo et al. | |
| 6,176,683 | B1 | 1/2001 | Yang | |
| 6,289,680 | B1 | 9/2001 | Oh et al. | |
| 6,520,746 | B2 | 2/2003 | Yoo et al. | |
| 6,524,075 | B2 | 2/2003 | Hwang et al. | |
| 6,527,519 | B2 | 3/2003 | Hwang et al. | |
| 6,537,034 | B2 | 3/2003 | Park et al. | |
| 6,541,953 | B2 | 4/2003 | Yoo et al. | |
| 6,554,577 | B2 | 4/2003 | Park et al. | |
| 6,623,246 | B2 | 9/2003 | Hwang et al. | |
| 6,715,301 | B2 | 4/2004 | Song | |
| 2003/0175125 | A1 * | 9/2003 | Kwon et al. | 417/44.11 |
| 2004/0095028 | A1 * | 5/2004 | Shearer et al. | 310/12 |
| 2004/0239266 | A1 * | 12/2004 | Lee et al. | 318/119 |

FOREIGN PATENT DOCUMENTS

| | | |
|---|---|---|
| WO | WO 01/54253 | 7/2001 |
| WO | WO 2005/045248 A1 | 5/2005 |

* cited by examiner

*Primary Examiner* — Kakali Chaki
*Assistant Examiner* — Tejal Gami
(74) *Attorney, Agent, or Firm* — Farjami & Farjami LLP

(57) ABSTRACT

A method of protecting a cylinder of a compressor comprising a piston, a linear permanent magnet (PM) having a coil and a magnet, and a sensor-less control of the PM for moving the piston in and out of the cylinder. The method including the steps of receiving a reference position of the piston from a temperature control loop; deriving a compensation voltage and a load spring effect information from a current through the coil; providing a model input voltage to a model of a mechanical structure of the compressor for predicting position of the piston, the model input voltage comprising a first voltage derived from the reference position; a compressor input voltage comprising the first voltage and the compensation voltage; and using a position control loop to recognize when the maximum compression ratio is desired and controlling the piston to achieve maximum compression ratio without causing damage to the discharge valve.

14 Claims, 4 Drawing Sheets

SENSOR-LESS CONTROL METHOD FOR LINEAR COMPRESSORS

CROSS-REFERENCE TO RELATED APPLICATION

This application is based on and claims priority to U.S. Provisional Patent Application Ser. No. 60/775,283, filed on Feb. 21, 2006 and entitled AN IMPROVED SENSOR-LESS CONTROL METHOD FOR LINEAR COMPRESSORS, the entire contents of which are hereby incorporated by reference herein.

BACKGROUND OF THE INVENTION

The present invention relates to linear compressors and more particularly to an improved method for sensor-less control of the linear compressors.

In the past six to seven years, linear compressors have gained increased popularity due to simplifications in their mechanical structure, ease of use when driven at both fixed and variable capacity, and higher efficiency.

Linear permanent magnet (PM) machines are very simple. They are formed from a fixed coil and a moving magnet or, vice-versa, a fixed magnet and a moving coil. Such linear PM machines are well known in the audio field as the basic voice coil actuator for loudspeakers.

The mechanical structure of the linear compressors is greatly simplified in that the piston arrangement, commonly driven by a rotating electrical machine through complex mechanical couplings, is now driven directly as a linear PM machine.

Also, the thermodynamic efficiency of the linear compressor is improved when gas leakage, existing in the piston/cylinder arrangement of the linear compressor is greatly reduced.

One of the most critical points in driving linear compressors is avoiding damaging the piston with an end of the cylinder that the piston moves into, where the discharge valve is normally placed. If this occurs, damage to the valve will occur or, long term reliability of the mechanical structure will be affected.

In compressor engineering terms, the cylinder end is called top dead point (TDC), the aim of the control is to move the piston in a way that it reaches TDC near zero, where maximum compression ratio is achieved. Another aim of the control is to control the piston movement so precisely that any distance from TDC is reached, when a compression ratio lower than the maximum is desired. This occurs, for example, when variable capacity is required of the compressor.

FIG. 1 illustrates a linear compressor structure 10. Spring 6 is added to the moving piston 1, which usually equipped with permanent magnets 4 when the fixed coil-moving magnets arrangement is implemented.

The combination of the piston mass with the springs is a mechanically resonant system, and the force required to move this system is provided by any current flowing into the coil 5, interacting with the flux generated by the permanent magnets 4 mounted on the piston.

Such current is usually an AC current with frequency that is tuned at the same mechanical resonance as that of the piston/spring arrangement. The current may be a sinusoidal or any AC waveform. The resonance curve of the mechanical part is usually so stiff that any harmonic higher than the fundamental in the coil's current does not produce any significant effect.

Unfortunately, the mass/spring arrangement also includes a very unpredictable gas spring effect. The gas spring effect is not symmetric with respect to the piston rest position, i.e., a position of the piston when a current of the coil 5 is equal to zero. In fact, the force that the gas exercises, always acts in the same direction with high values during the compression phase and low values during the suction phase.

Early attempts to accurately control piston movement utilized piston position sensors. Such sensors are bulky and expensive, moreover, getting sensor cables out from the sealed compressor's shell is hard and creates additional problems.

Recently, several sensor-less control schemes have been proposed. Some of these schemes are discussed below. Almost all of the schemes may be seen as simplification of a more general control scheme known as the Luenberger observer. Most of the sensor-less control schemes use a simplified observer model, and some external mechanical parameters, i.e., temperatures or pressures, to correct the observer's predictions as the load, e.g., a gas spring, is strongly changing with the operating conditions In almost all of the schemes, 50 Hz or 60 Hz operation is described. The reason for this choice of the line frequency as the mechanical resonance frequency is back-compatibility with fixed speed compressors. The fixed speed compressors are running directly from the line voltage, without any electronic control. This, however, may not be the best choice in term of optimization of the mechanical structure.

DESCRIPTION OF THE PRIOR ART

U.S. Pat. Nos. 5,342,576 and 5,496,153 are two of the oldest on the subject. They describe the basic structure of the compressor as well as a compressor's sensor-less control. A very important concept, embedded in the Abstract of these patents is that both, DC and AC position must be measured.

This is due to the fact that the average pressure on the piston in a reciprocation cycle is not zero, since the pressure is high during compression and low during suction. Average pressure force on the piston is counteracted by an equal, opposite spring force. Therefore, DC position cannot be "zero".

These patents describe deriving the AC component of the position by simple integration of speed, which is, in turn, derived by the electrical circuit equation. This is practically a simple Back Electromotive Force (BEMF) based approach. Derivation of the DC component is a bit trickier, this component is derived by a signal proportional to the moving body acceleration, achieved by time derivative of the speed.

U.S. Pat. No. 5,809,792 describes a variable capacity compressor based on linear motor. Here, the capacity of the compressor is controlled by controlling the stroke amplitude, not the frequency. The frequency is controlled through the voltage applied to the linear motor or the current into it. The stroke distance is measured through a sensor. Instead of measuring, the stroke amplitude is computed by looking at the suction and discharge pressure at the stator's current and at the temperature at the outlet of the evaporator. No description of how to do that is provided.

U.S. Pat. No. 5,947,693 describes using a position sensor but due to the frequency response of the mechanical system, there exist a phase delay between the current pulse and the piston position (Sp). Such delay depends on the actual load seen by the motor and should be carefully controlled to optimize compressor's efficiency. To allow that, an inverter is required with a proper control to generate the correct PWM as a function of the stroke amplitude or the Sp peak value, but also as function of the phase difference between the current and the piston position.

U.S. Pat. No. 6,176,683 describes that the most known sensor-less method is based on BEMF detection to calculate speed, then integration of speed to achieve stroke amplitude. However, the load changes the initial piston position, thus making constant top dead volume not possible.

To compensate for that and to achieve constant top dead volume, a collision detector is described. When the control detects collision between the piston and the discharge valve, the next stroke amplitude is recalculated and the voltage/current is modulated to achieve the re-calculated stroke. Collision detector can be a simple piezo sensor.

Alternatively, amplitude of the current can be used to detect collisions and a similar algorithm to re-calculate the next stroke can be implemented. But, a capacitor, which function is not explained, in series to the coil is needed. Perhaps this capacitor is used to limit the current at the collision.

WO 01/54253 teaches using a triac controlled linear compressor and a way to control the stroke amplitude by having a "stroke generator". This is not well described but it may be a secondary winding coupled with the piston mounted PM, which generates an AC waveform whose amplitude is proportional to the stroke amplitude. Such AC is used in a closed loop to modulate the triac firing angle, hence the motor's current.

Such system has drawbacks due to the errors introduced in the stroke amplitude reading. To compensate for such errors, the motor's current is read and integrated and the phase difference between the integrated current and the position (the signal coming from the stroke generator) is used to control the triac firing angle. The principles are not explained, but it appears that such phase difference may be related to pressure. So that it can be used as "sensor" for the gas pressure.

U.S. Pat. No. 6,289,680 teaches a basic principle that comes from observing that piston movement becomes unstable when very near to discharge valve, almost touching it. This kind of unstable operation depends on suction and discharge pressure and, ultimately, on outside air temperature.

Thus, a classical triac sensor-less control, where a piston position is estimated by simply reading current and voltage across the motor, is modified by adding an "instability monitoring unit", able to detect unstable operation by just looking at the output of the stroke estimator. Then, the algorithm is simply to search and skip, in a way to maintain stroke amplitude as close as possible, but outside the instability region. This assures the stroke amplitude is near its maximum. However, since the instability region does not exist if $T_{AMB}$ is below a certain threshold or above another threshold, $T_{AMB}$ has to be monitored and if too high or too low, the algorithm is changed to simply command fixed stroke amplitude.

Further, tolerances in the estimator and in the mechanical arrangement are discussed. A "self-tuning" method is described, that increases the amplitude of the stroke until the instability region is reached (the self-tuning is only possible if $T_{AMB}$ stays in a certain range) then correct the reading of the estimator. The control algorithm is a bit more complex, because instability region can move with the life of the compressor, which obliges the controller to continuously look for instability as a "reference point".

U.S. Pat. No. 6,524,075 describes performing sensor-less control by reading voltage across the motor and current into the motor. The idea is not well described, but it seems that the principle stays in the relationship between the piston displacement, i.e., the stroke, and the current. The displacement is derived by current and voltage as in the above discussed references.

A displacement vector, which is a function of displacement and current, and a current vector, which is again a function of current and displacement, are generated, their magnitude and phase calculated, then the difference of magnitudes of these two vectors and the ratio between their phases are derived. From these two values the command for the triac is generated.

U.S. Pat. No. 6,520,746 teaches to avoid the use of a stroke calculating unit, which may yield wrong values due to calculation errors and motor's parameters spread or variation with temperature and life. Instead, phase difference between motor's voltage and current is measured, because it may be shown that such phase presents a minimum (except at very low ambient temperatures) which corresponds to optimal TDC. In those cases where phase minimum doesn't exist, fixed stroke is applied.

U.S. Pat. No. 6,527,519 describes using two parameters to control the stroke: the current and the suction/discharge pressures. It may be shown that, when the pressures are fixed, the relationship between the integral of the current over one cycle, called "work", and the applied voltage, which is the "duty ratio" or phase angle of triac firing, shows a sharp increase near the TDC. The control systems stores the relationships between current integral and pressures, and is able to recognize the right duty cycles, when, by slightly increasing the duty cycle, a sharp increase in current integral is observed. A similar relationship can also be achieved between the integral of the current displacement and the duty ratio when the pressures are known.

U.S. Pat. No. 6,537,034 integrates the ideas included in the previous two ones, extending them to also include the case the integral of the half-wave rectified current is used as work function. Moreover, a slight modification of the method is described, where not the "work" but its variation from the previous cycle to the following one is considered, generating a "gain" function, which is then used to control the triac firing angle.

U.S. Pat. No. 6,541,953 extends the subject matter of U.S. Pat. No. 6,289,680. Here, instabilities of the compressor near TDC are detected as quick changes in the phase between motor's voltage and current, or between piston speed, which is detected by the BEMF, and current, or between displacement and current.

U.S. Pat. No. 6,554,577 extends the subject matter of U.S. Pat. No. 6,524,075. The controller stores the current-displacement pattern corresponding to TDC and recalculates the actual pattern for every command. Then, the command is changed until the reference and the actual pattern are equal to each other.

U.S. Pat. No. 6,623,246 describes a simplification of the previous controls. It appears that, when near TDC, the current in the motor rises sharply. This current peak is an indication of optimal control point. Nevertheless, this current peak may change with the load, which changes during the operation of the compressor. So, the peak current at TDC has to be detected not only at the beginning, but periodically during the working time. Several methods are possible for judging if and when to re-detect this peak current. One of the methods is based on time, another on reading power consumption, and a third on comparing values of the current and duty cycle variations.

U.S. Pat. No. 6,715,301 clarifies the working principle of the sensor-less operation. BEMF is calculated as difference between applied voltage and $L_{di/dt}$. Stator resistance drop is neglected. Nevertheless, inductive drop has to be minimized so as to apply to the motor as much voltage as possible. Hence, the need to place a series capacitor, calculated to resonate with stator's inductance at the frequency of operation. At this point, BEMF simply becomes applied voltage-resistive drop.

By requiring control of the triac firing angle, the stroke control generates line current harmonics, which may be outside regulation limits due to the small equivalent inductive impedance. Therefore, a method for maintaining an almost constant firing angle while changing the stroke as a function of the compressor's load has to be found. Also switching between different capacitor values as the load changes is proposed.

International Patent Application WO 2005/045248 teaches that a phase difference between a main's voltage and the motor's current may be used to control the stroke. When the load is at its maximum, a maximum stroke is applied. When the load is lower and the variable capacity control has to be applied, triac firing angle is made asymmetric between compression and suction. This is to avoid the piston being pushed backward at the time of suction.

U.S. Pat. No. 5,980,211, filed on Apr. 18, 1997 and assigned to Sanyo Electric Co., includes several variations of a basic control structure, which maintains zero phase shift between the motor's speed and current. In all cases, a position sensor is used. Phase is controlled with Phase-Locked Loop (PLL) circuitry, which adjusts frequency around resonance to achieve zero phase shift.

The above-discussed prior art references evidences the following:

a) Basic sensor-less schemes rely of integration of speed achieved by solution of the electrical equation. Inductance cannot be neglected, which in turn calls for a derivative operation by the controller. Digital derivative is very dangerous, but possibly not a problem because all waveforms are SO/60 Hz.

b) Simple calculation of piston position is not enough, because of the changes in the motor parameters, i.e., spread and variation with temperature/life, and mainly because of strong changes in the load characteristics. In all cases, the most common problem to be solved was to avoid impact of the piston with the discharge valve, while maintaining the TDC (the top dead volume) near zero to achieve maximum compression ratio.

c) The correction methods to this simple position calculations vary, but a common sense can be found in trying to find an electrical parameter which behavior tells the controller that the piston is near to TDC=0.

d) Very early references used a collision piezo detector, or even a "sensing" winding.

Most recent references use phase difference between current integral and position; instabilities in the position estimator; phase difference between motor's voltage and current; the phase difference between current integral and voltage; or simply the current peak. In some cases, such control method has to be further corrected with information coming from the temperature or pressure sensors reading suction/discharge pressures, which are indicative of the actual compressor loading.

SUMMARY OF THE INVENTION

It is an object of the present invention to provide a novel control method that utilizes information derived from a coil's current to correct observer's predictions.

It is therefore an object of the present invention to provide an improved control method in which the coil's current includes all the information about the mechanical system and the load spring effect.

It is another object of the present invention to provide a control method which allow the piston position to be precisely controlled to reach the near zero TDC when maximum compression ratio is desired, and to achieve any piston position relative to the top dead point in case compression ratio lower than the maximum is needed.

It is a further object of the present invention to allow the mechanical structure to be designed to work with any resonance frequency, thus allowing optimization of the mechanical structure itself.

Provided is a method of protecting a cylinder of a compressor comprising a piston, a linear permanent magnet (PM) having a coil and a magnet, and a sensor-less control of the PM for moving the piston in and out of the cylinder, the cylinder having a discharge valve and the piston being coupled to a spring, the compressor achieving a maximum compression ratio when the piston reaches a Top Dead Point near zero. The method including the steps of receiving a reference position of the piston from a temperature control loop, the reference position indicating a compression ratio; deriving a compensation voltage and a load spring effect information from a current through the coil; providing a model input voltage to a model of a mechanical structure of the compressor for predicting position of the piston, the model input voltage comprising a first voltage derived from the reference position; providing a compressor input voltage to the compressor, the compressor input voltage comprising the first voltage and the compensation voltage; and using a position control loop to recognize when the maximum compression ratio is desired and controlling the piston to achieve maximum compression ratio without causing damage to the discharge valve.

Other features and advantages of the present invention will become apparent from the following description of the invention that refers to the accompanying drawings.

DETAILED DESCRIPTION OF EMBODIMENTS OF THE INVENTION

Figure 1:
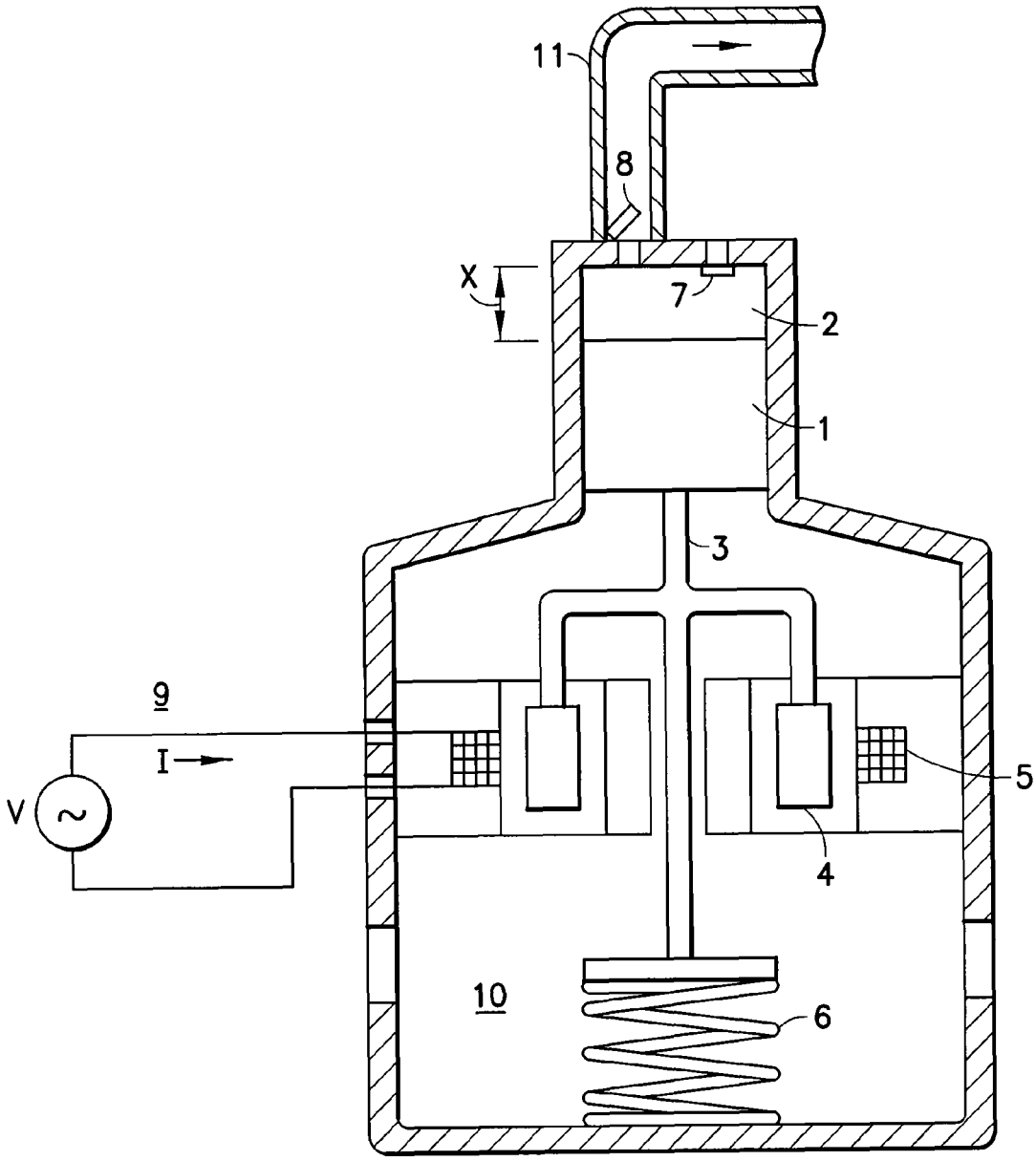
FIG. 1 PRIOR ART
FIG. 1 is a diagram of a prior art linear compressor structure.
Figure 2:
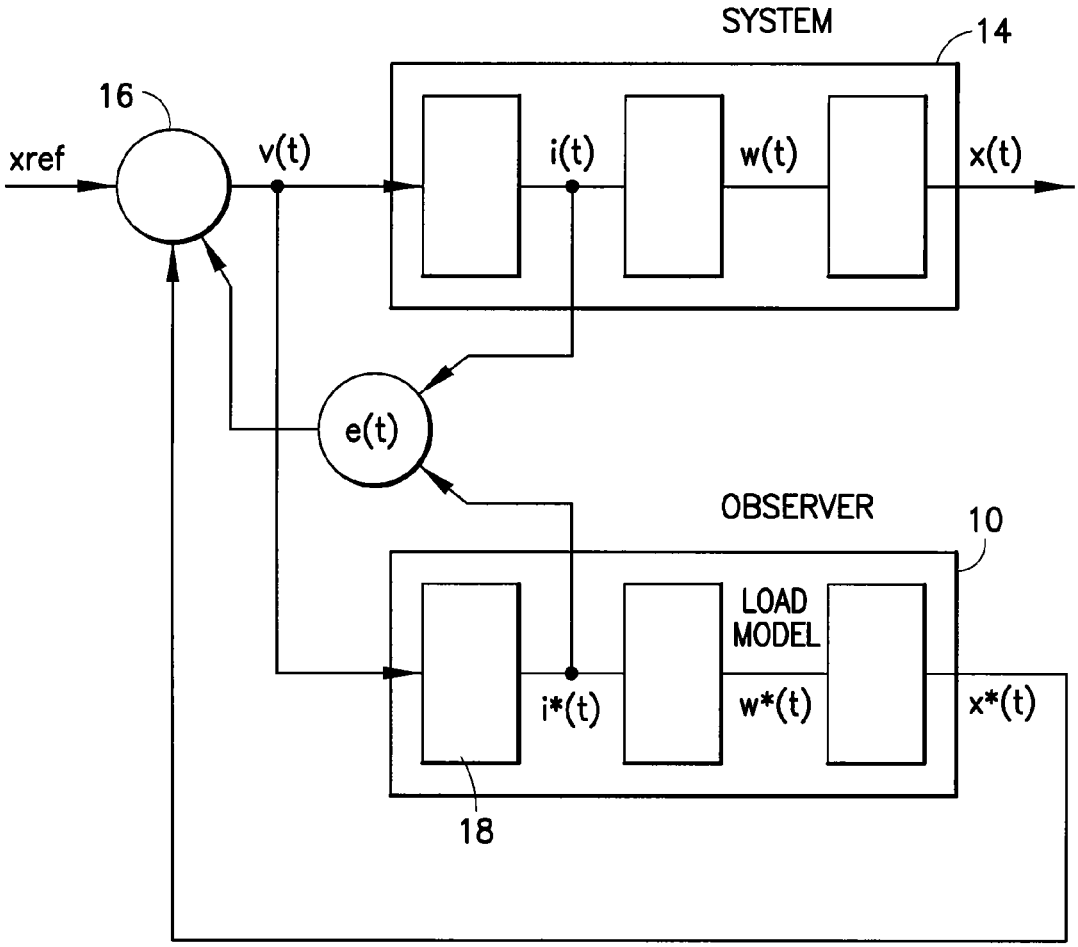
FIG.2 PRIOR ART
FIG. 2 is a block diagram of a prior art control structure for a linear compressor.

A generalized Luenberger observer control structure 10 for controlling a linear compressor 14 is illustrated in FIG. 2. A simplification of the structure 10 can be recognized in most of the prior art references. Without a position sensor, the only observable parameter in the structure 10 is the current i*(t). The current error, in its various forms, is used to correct an estimation of a of a piston position coming from the observer block 10.

Figure 3:
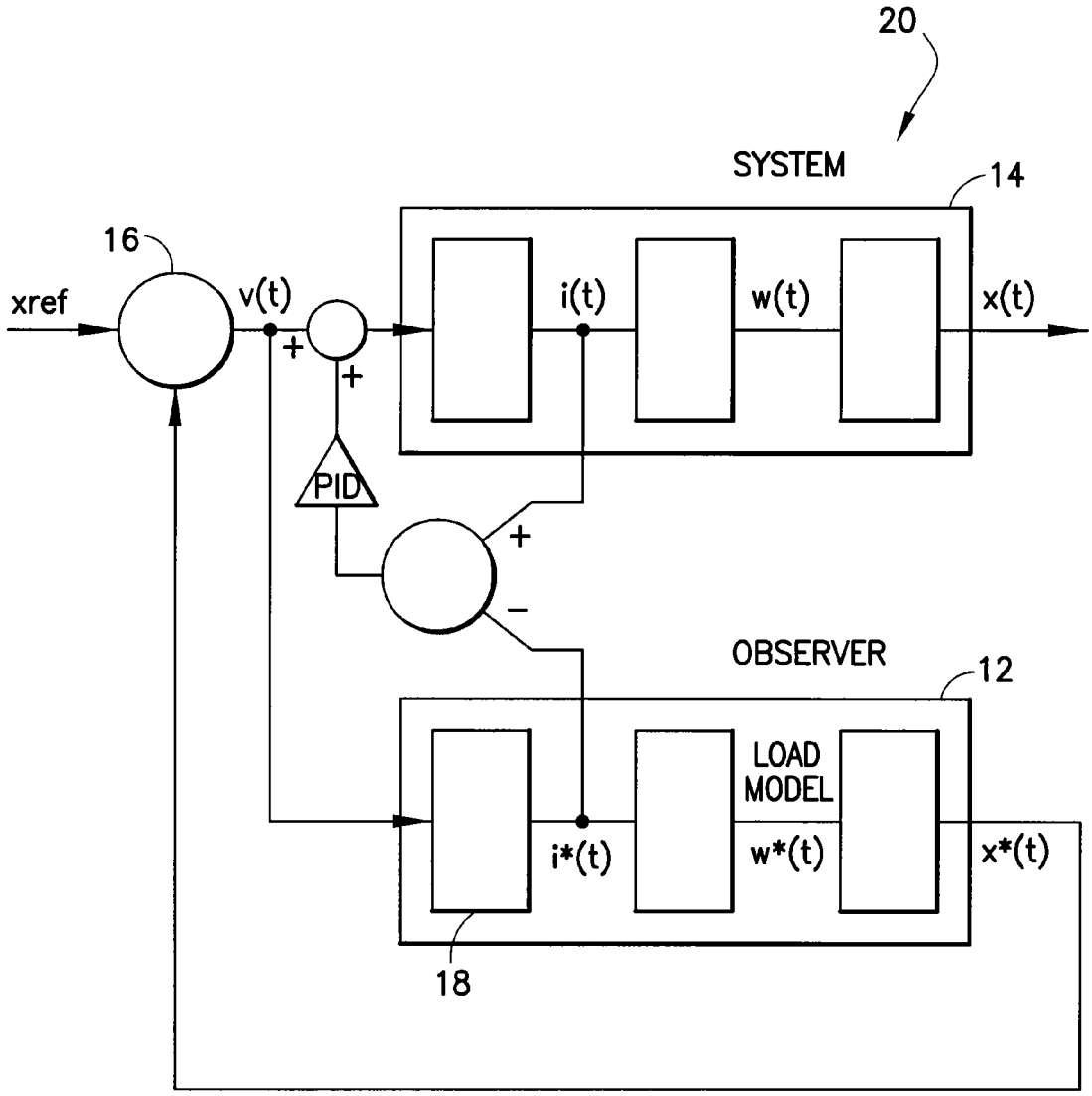
FIG. 3 is a block diagram of an improved control structure for a linear compressor in accordance with the present invention.

FIG. 3 illustrates a control structure 20 of one embodiment of the present invention. High frequency components of an error between an actual current i(t) from the linear compressor system block 14 and a current i*(t) in the system model or the observer block 12 include all information about the linear compressor system 14 that is to be controlled.

The observer block 12 is a model of a motor and of a mechanical system. It may be advantageously implemented by iMotion digital control hardware structure, which is characterized by extremely fast computation of the coupled electrical-mechanical equations describing the linear compressor system and is manufactured by the International Rectifier Corporation.

By taking advantage of such computation speed, mechanical resonance is no more constrained to line frequency, and the mechanical structure can be optimized to run at any frequency. A well known mono-phase inverter of Full- or Half-Bridge types (not shown) may be used as an actuator instead of a simple triac.

The reference position of a piston, which defines the compression ratio of the compressor and is derived from a well known main refrigerator temperature control loop (not shown), is represented by xref. Because piston position is not directly measured, only its estimation x*(t) can be used as a feedback signal.

A controller 16, generates voltage v(t) which feeds the compressor model 12. The actual compressor 14 is fed by the voltage v(t) and a compensation voltage v(comp) derived by a PID block, whose function is to keep the error between the estimated current i*(t) and the actual current i(t) to zero.

Because the current error is different from zero for any possible mismatch between the system or observer model 12 and the actual system 14, reducing the current error to zero means reducing to zero the mismatch between the observer and the system, thus reducing to zero the error between the estimated and the actual positions x*(t) and x(t). Therefore, the estimated position becomes a reliable feedback information for the main position feedback loop. As stated above, the reference position of a piston indicates a compression ratio.

Figure 4:
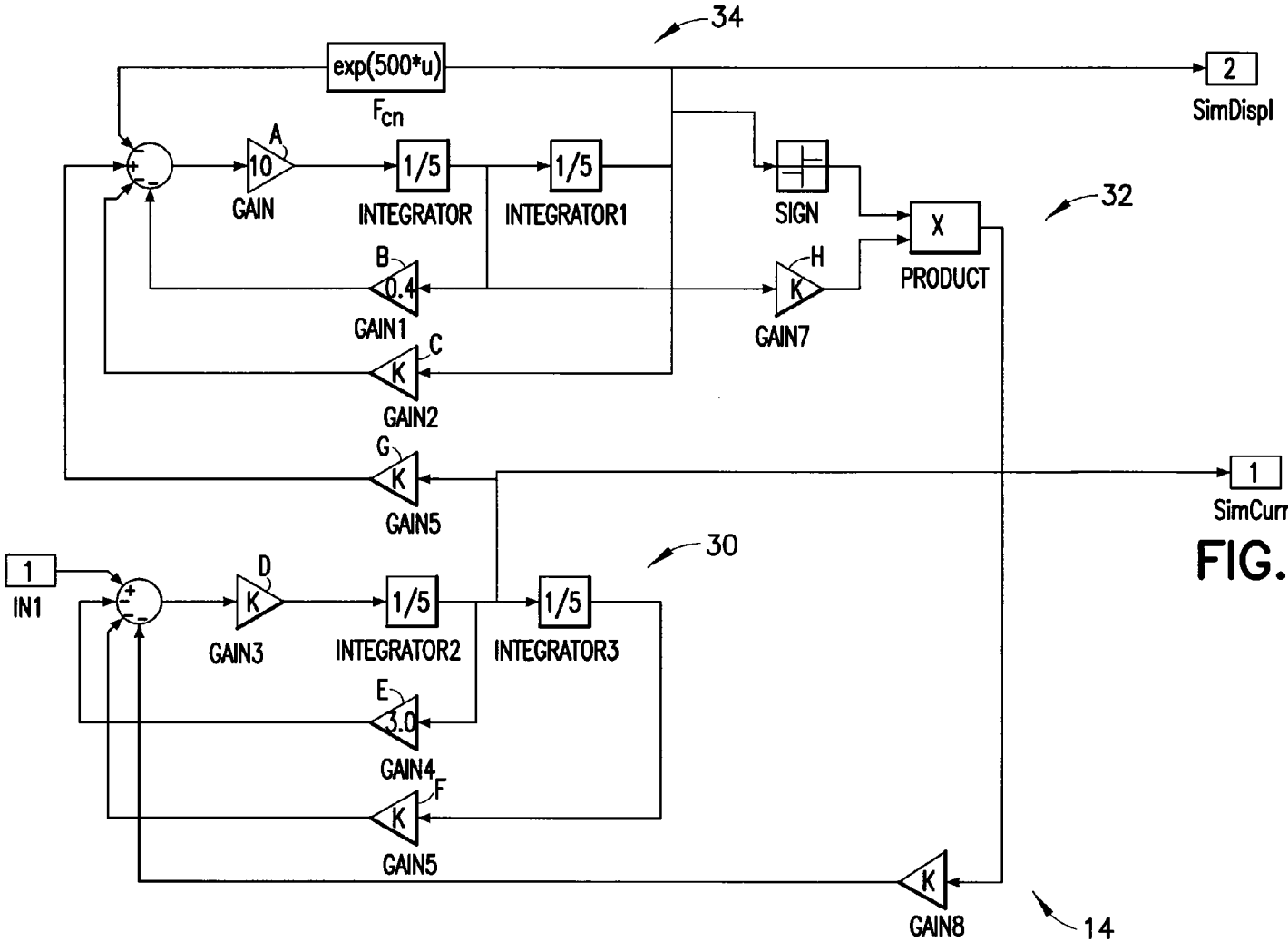
FIG. 4 is a block diagram of the observer model of FIG. 3.

The detailed system observer model 12 is shown in FIG. 4. The applied voltage is provided at In1. The lower series of blocks 30 represent the electrical equations. The upper series of blocks 32 represent the mechanical equations. The top upper, function block 34 is the gas spring model.

There are several gains A-I in the model. Some of the gains are related to the permanent magnet flux, others to the coil's resistance, still others to the mechanical spring constant, and others to a friction coefficient. All of these gains may have mismatches between the values included in the observer and their actual values in the real compressor. An actual spring coefficient may be different because of mechanical wear out. A PM flux may be different due to spread in the magnets or because of partial saturation of the magnets. The coil's resistance may change with temperature, and the gas spring effect may be much different from a simple model implemented in the observer 12.

Nevertheless, any difference between the model and the actual system is reflected in an error between the estimated current i*(t) and the actual measured current i(t). By compensating such error, the mismatches between the model and actual system are compensated.

Therefore, when the temperature loop directs the piston to a position too close to the top dead point, such that the discharge valve can be damaged, the position control loop can recognize and avoid it.

Similarly, if the temperature loop assigns a lower compression ratio and, therefore, a lower piston displacement, the position control loop can recognize it and direct the piston to a lower displacement.

However, to achieve that, it is important that the actuator is fast enough to react to high frequency components of the error between estimated and measured current. This is made possible by using an inverter running at switching frequency that is much higher than the mechanical resonance frequency.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A method of protecting a cylinder of a compressor comprising a piston, a linear permanent magnet (PM) having a coil and a magnet, and a sensor-less control of the PM for moving the piston in and out of the cylinder, the cylinder having a discharge valve and the piston being coupled to a spring, the compressor achieving a maximum compression ratio when the piston reaches a Top Dead Point near zero, the method comprising the steps of:

receiving a reference position of the piston from a temperature control loop, the reference position indicating a compression ratio;

deriving a compensation voltage and a load spring effect information from a current through the coil, wherein said compensation voltage is derived by comparing a first actual current from the compressor and a second estimated current of the compressor;

providing a model input voltage to a model of a mechanical structure of the compressor for predicting position of the piston, the model input voltage comprising a first voltage derived from the reference position;

providing a compressor input voltage to the compressor, the compressor input voltage comprising the first voltage plus the compensation voltage; and using a position control loop to recognize when the maximum compression ratio is desired and controlling the piston to achieve maximum compression ratio without causing damage to the discharge valve.

2. The method of claim 1, wherein the model includes digital control hardware having coupled electrical-mechanical equations describing the linear compressor, the equations having extremely fast computation speed.

3. The method of claim 2, wherein the model further includes a model of a motor.

4. The method of claim 1, wherein high frequency components of an error between said first actual current from the compressor and said second estimated current of the compressor from the model include information about the compressor, and a current resonance frequency of the first current is same as mechanical resonance of the spring coupled to the piston.

5. The method of claim 4, further comprising a step of optimizing the compressor to work with any resonance frequency by taking advantage of the computation speed of the equations, wherein a mechanical resonance of the compressor is not constrained to a line frequency.

6. The method of claim 1, wherein the compensation voltage is derived by a function that keeps a current error between said first current and said second current at zero.

7. The method of claim 6, further comprising a step of the model estimating a position of the piston to be used as a feedback signal in the position control loop.

8. The method of claim 7, wherein the function that keeps the current error at zero reduces a mismatch between the first and second currents to zero, the current error being different from zero for any possible mismatch between the compressor and the model, whereby an error between the estimated and the actual positions of the piston are thus reduced to zero.

9. The method of claim 8, further comprising a step using a mono-phase inverter selected from one of Full-Bridge and Half-Bridge types as an actuator that is fast enough to react to high frequency components of the error between the first and second currents.

10. The method of claim 9, further comprising a step of controlling the piston to achieve piston position at a distance relative to the Top Dead Point when less than maximum compression ratio is desired to provide variable capacity of the linear compressor.

11. The method of claim 1, wherein the compensation voltage is derived by a function that keeps a current error between the first current and the second current at zero.

12. The method of claim 11, wherein the model estimates a position of the piston to be used as a feedback signal in the position control loop.

13. The method of claim 12, wherein the function that keeps the current error at zero reduces a mismatch between the first and second currents to zero, the current error being different from zero for any possible mismatch between the compressor and the model, whereby an error between the estimated and the actual positions of the piston are thus reduced to zero.

14. The method of claim 13, wherein a mono-phase inverter selected from one of Full-Bridge and Half-Bridge types is used as an actuator that is fast enough to react to high frequency components of the error between the first and second currents, the actuator is operated by an inverter running at switching frequency that is much higher than the mechanical resonance frequency.

* * * * *